US007998279B2

(12) United States Patent
Schütz et al.

(10) Patent No.: US 7,998,279 B2
(45) Date of Patent: Aug. 16, 2011

(54) LIQUID DETERGENT COMPOSITION COMPRISING AN AMPHIPHILIC GRAFT POLYMER

(75) Inventors: Tristan Schütz, Brussels (BE); Stephen Michael Grindell, Eltham (AU); Frank Hulskotter, Bad Duerkheim (DE); James Lee Danziger, Bad Soden (DE); Maria Angeles Gomez Ruiz, Grimbergen (BE); Kevin George Goodall, Tervuren (BE); Valerio Delduca, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/128,284

(22) Filed: May 28, 2008

(65) Prior Publication Data

US 2008/0300158 A1 Dec. 4, 2008

(30) Foreign Application Priority Data

May 29, 2007 (EP) ..... 07109087
Jun. 29, 2007 (EP) ..... 07111413
May 15, 2008 (EP) ..... 08156229

(51) Int. Cl.
*B08B 3/04* (2006.01)
*C11D 3/37* (2006.01)

(52) U.S. Cl. ..... 134/25.2; 134/25.3; 134/42; 510/220; 510/230; 510/475

(58) Field of Classification Search ..... 134/25.2, 134/25.3, 42; 510/220, 230, 475
See application file for complete search history.

(56) References Cited

U.S. PATENT DOCUMENTS

| | | | | |
|---|---|---|---|---|
| 2,503,280 | A | 4/1950 | Lockwood | |
| 2,507,088 | A | 5/1950 | Bradley | |
| 3,260,744 | A | 7/1966 | Ito | |
| 3,372,188 | A | 3/1968 | Alston | |
| 5,798,505 | A | 8/1998 | Lee | |
| 5,866,529 | A | 2/1999 | Erilli | |
| 6,009,181 | A | 12/1999 | Kim | |
| 6,020,303 | A | 2/2000 | Cripe | |
| 6,060,443 | A | 5/2000 | Cripe | |
| 6,380,150 | B1 | 4/2002 | Toussaint | |
| 2005/0107275 | A1 | 5/2005 | Hecht | |
| 2007/0281879 | A1 * | 12/2007 | Sharma et al. | 510/475 |

FOREIGN PATENT DOCUMENTS

| | | | |
|---|---|---|---|
| EP | 429307 | * | 5/1991 |
| WO | WO 99/05082 | | 2/1999 |
| WO | WO 99/05084 | | 2/1999 |
| WO | WO 99/05241 | | 2/1999 |
| WO | WO 99/05242 | | 2/1999 |
| WO | WO 99/05243 | | 2/1999 |
| WO | WO 99/05244 | | 2/1999 |
| WO | WO 99/07656 | | 2/1999 |
| WO | WO 00/23548 | | 4/2000 |
| WO | WO 0023549 | | 4/2000 |

* cited by examiner

*Primary Examiner* — Brian P Mruk
(74) *Attorney, Agent, or Firm* — David V. Upite; John T. Dipre; Leonard W. Lewis

(57) ABSTRACT

A method of cleaning dishware with a liquid detergent composition having an amphiphilic graft polymer, to provide improved grease cleaning and sudsing.

16 Claims, No Drawings

LIQUID DETERGENT COMPOSITION COMPRISING AN AMPHIPHILIC GRAFT POLYMER

FIELD OF INVENTION

The present invention relates to a method of cleaning dishware with a liquid detergent composition comprising an amphiphilic graft polymer to provide improved baked-on grease cleaning from dish surfaces and improved suds profile.

BACKGROUND OF THE INVENTION

Grease cleaning with liquid detergents poses an ongoing problem for consumers. Consumers utilizing liquid detergent as a light-duty liquid dishwashing detergent composition tend to wash greasy, difficult to clean items at the end of their washing experience, after easier to clean items such as glasses and flatware are cleaned. Light-duty liquid dishwashing detergent compositions require a high suds profile while providing grease cleaning.

It has been surprisingly found that the method of the present invention is highly efficient in removing grease and in particular the more difficult baked-on grease layer. Without wishing to be bound by theory, it is believed that this baked-on grease is characterized by a higher hydrophobicity. The removal of such baked-on grease therefore requires surfactants with strong hydrophobic properties in order to penetrate and fluidify efficiently the grease layer and/or requires very high level of total surfactants.

However, the use of significant levels of such highly hydrophobic surfactants presents the disadvantages of acting as soil itself and hence of monopolizing the other surfactants of the composition. Thereby, it reduces the efficiency of the composition on the basic regular grease cleaning. It has also been found that the introduction of significant levels of hydrophobic surfactants cause phase instability and suds suppression, which limits their use in dishwashing compositions.

It has been found further that the alternative route of extreme high levels of total surfactant cause phase stability issues even if the presence of hydrophobic surfactants is minimized. High levels of total surfactant are typically found in more concentrated dishwashing liquids. It has been found that the addition of the amphiphilic graft polymer of the present invention allows that total surfactant level to be maintained or even reduced whilst still maintaining or even improving grease performance.

Furthermore, it has been found that the amphiphilic graft polymer of the present invention improves the suds profile of the light-duty liquid dishwashing detergent composition to be used in the method of the present invention. It increases suds mileage, especially in soft water.

Therefore, the present invention teaches a method of washing dishes with a liquid detergent composition comprising a specific amphiphilic graft polymer.

SUMMARY OF THE INVENTION

The present application relates to a method of cleaning dishware with a liquid detergent composition comprising an amphiphilc grafted polymer.

In an alternative embodiment, the present invention also encompasses the use of an amphiphilic graft polymer in a liquid dishwashing composition for improved grease cleaning properties, especially for improved baked-on grease cleaning.

The present invention further encompasses the use of an amphiphilic graft polymer in a liquid dishwashing composition to improve the sudsing profile.

DETAILED DESCRIPTION OF THE INVENTION

The method of cleaning dishware of the present invention surprisingly provides improved grease cleaning, especially on baked-on grease while maintaining acceptable levels of total amount of such cleaning and improved suds profile in a liquid dishwashing deterrent composition.

As used herein "grease" means materials comprising at least in part (i.e., at least 0.5 wt % by weight of the grease) saturated and unsaturated fats and oils, preferably oils and fats derived from animal sources such as beef and/or chicken.

As used herein "baked-on grease" means materials comprising grease exposed to increased temperatures in a standard oven, convection oven, toaster oven, microwave oven, stove top heating using a frying pan, wok, hot plate, electric griddle, or other known cooking appliances used to heat food during cooking.

As used herein "suds profile" means amount of sudsing (high or low) and the persistence of sudsing (sustained or prevention) throughout the washing process resulting from the use of the liquid detergent composition of the present composition. Liquid dishwashing detergent compositions require high sudsing and sustained suds. This is particularly important with respect to liquid dishwashing detergent compositions as the consumer uses high sudsing as an indicator of the performance of the detergent composition. Moreover, the consumer in a liquid dishwashing detergent composition also uses the sudsing profile as an indicator that the wash solution still contains active detergent ingredients. The consumer usually renews the wash solution when the sudsing subsides. Thus, a low sudsing liquid dishwashing detergent composition formulation will tend to be replaced by the consumer more frequently than is necessary because of the low sudsing level.

As used herein "dishware" means a surface such as dishes, glasses, pots, pans, baking dishes and flatware made from ceramic, china, metal, glass, plastic (polyethylene, polypropylene, polystyrene, etc.) and wood.

As used herein "light-duty liquid dishwashing detergent composition" refers to those compositions that are employed in manual (i.e. hand) dishwashing. Such compositions are generally high sudsing or foaming in nature.

As used herein "cleaning" means applying to a surface for the purpose of cleaning, and/or disinfecting.

The Process of Cleaning/Treatment a Dishware

The present invention is directed to a process of cleaning a dishware with a liquid composition comprising the amphiphilic graft polymer as described herein. Said process comprises the steps of applying said composition onto said dishware, typically in diluted or neat form and rinsing or leaving said composition to dry on said surface without rinsing said surface.

By "in its neat form", it is meant herein that said liquid composition is applied directly onto the surface to be treated without undergoing any dilution by the user (immediately) prior to the application. By "diluted form", it is meant herein that said liquid composition is diluted by the user with an appropriate solvent, typically with waters. By "rinsing", it is meant herein contacting the dishware cleaned with the process according to the present invention with substantial quantities of appropriate solvent, typically water, after the step of applying the liquid composition herein onto said dishware. By "substantial quantities", it is meant usually 5 to 20 liters.

In one embodiment of the present invention, the composition herein can be applied in its diluted form. Soiled dishes are contacted with an effective amount, typically from 0.5 ml to 20 ml (per 25 dishes being treated), preferably from 3 ml to 10 ml, of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. Suitable examples may be seen below in Table A.

Generally, from 0.01 ml to 150 ml, preferably from 3 ml to 40 ml of a liquid detergent composition of the invention is combined with from 2000 ml to 20000 ml, more typically from 5000 ml to 15000 ml of water in a sink having a volumetric capacity in the range of from 1000 ml to 20000 ml, more typically from 5000 ml to 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from 1 to 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from 1 to 5 seconds. The absorbing device, and consequently the undiluted liquid dishwashing composition is then contacted individually to the surface of each of the soiled dishes to remove said soiling. The absorbing device is typically contacted with each dish surface for a period of time range from 1 to 10 seconds, although the actual time of application will be dependent upon factors such as the degree of soiling of the dish. The contacting of the absorbing device to the dish surface is preferably accompanied by concurrent scrubbing.

Liquid Composition

The composition used in the method according to the present invention is formulated as a liquid light-duty liquid dishwashing detergent composition comprising an amphiphilic graft polymer.

The Amphiphilic Graft Polymer of the Present Invention

The amphiphilic graft polymer will typically be present in the composition of the present invention at a level of from 0.01 wt % to 5.0 wt %, preferably from 0.1 wt % to 2.0 wt %, more preferably from 0.2% to 1.5% by weight of the composition.

(i) The polymer herein is a random graft copolymer having a hydrophilic backbone and hydrophobic side chains. Typically, the hydrophilic backbone is less than about 70%, less than about 50%, or from about 50% to about 2%, or from about 45% to about 5%, or from about 40% to about 10% by weight of the polymer. The backbone preferably contains monomers selected from the group consisting of unsaturated C1-6 acid, ether, alcohol, aldehyde, ketone or ester, sugar unit, alkoxy unit, maleic anhydride and saturated polyalcohol such as glycerol, and a mixture thereof. The hydrophilic backbone may contain acrylic acid, methacrylic acid maleic acid, vinyl acetic acid, glucoside, alkylene oxide, glycerol, or a mixture thereof. The polymer may contain either a linear or branched polyalkylene oxide backbone with ethylene oxide, propylene oxide and/or butylene oxide. The polyalkylene oxide backbone may contain more than about 80%, or from about 80% to about 100%, or from about 90% to about 100% or from about 95% to about 100% by weight ethylene oxide. The weight average molecular weight (Mw) of the polyalkylene oxide backbone is typically from about 400 g/mol to 40,000 g/mol, or from about 1,000 g/mol to about 18,000 g/mol, or from about 3,000 g/mol to about 13,500 g/mol, or from about 4,000 g/mol to about 9,000 g/mol. The polyalkylene backbone may be extended by condensation with suitable connecting molecules, such as dicarboxylic acids and/or diisocianates.

The backbone contains a plurality of hydrophobic side chains attached thereto, such as a C4-25 alkyl group; polypropylene; polybutyene; a vinyl ester of a saturated monocarboxylic C1-C6 acid; and/or a C1-6 alkyl ester of acrylic or methacrylic acid. The hydrophobic side chains may contain, by weight of the hydrophobic side chains, at least about 50% vinyl acetate, or from about 50% to about 100% vinyl acetate, or from about 70% to about 100% vinyl acetate, or from about 90% to about 100% vinyl acetate. The hydrophobic side chains may contain, by weight of the hydrophobic side chains, from about 70% to about 99.9% vinyl acetate, or from about 90% to about 99% vinyl acetate. The hydrophobic side chains may also contain, by weight of the hydrophobic side chains, from about 0.1% to about 10% butyl acrylate, or from about 1% to about 7% butyl acrylate, or from about 2% to about 5% butyl acrylate. The hydrophobic side chains may also contain a modifying monomer, such as styrene, N-vinylpyrrolidone, acrylic acid, methacrylic acid, maleic acid, acrylamide, vinyl acetic acid and/or vinyl formamide, especially styrene and/or N-vinylpyrrolidone, at levels of from about 0.1% to about 10%, or from about 0.1% to about 5%, or from about 0.5% to about 6%, or from about 0.5% to about 4%, or from about 1% to about 3%, by weight of the hydrophobic side chains.

The polymer may be formed by grafting (a) polyethylene oxide; (b) a vinyl ester from acetic acid and/or propionic acid; and/or a C1-4 alkyl ester of acrylic or methacrylic acid; and (c) modifying monomers. The polymer may have the general formulas

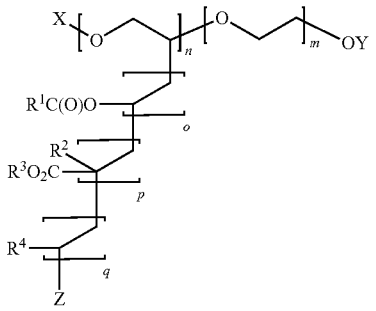

where X and Y are capping units independently selected from H or a C1-6 alkyl; each Z is a capping unit independently selected from H or a C-radical moiety (i.e., a carbon-containing fragment derived from the radical initiator attached to the growing chain as result of a recombination process); each R1 is independently selected from methyl and ethyl; each R2 is independently selected from H and methyl; each R3 is independently a C1-4 alkyl and each R4 is independently selected from pyrrolidone and phenyl groups. The Mw of the polyethylene oxide backbone is as described above. The value of m, n, o, p and q is selected such that the pendant group form at least 30%, at least 50%, or from about 50% to about 98%, or from about 55% to about 95%, or from about 60% to about 90% of the polymer, by weight. The polymer useful herein typically has a Mw of from about 1,000 g/mol to about 150,000 g/mol, or from about 2,500 g/mol to about 100,000 g/mol, or from about 7,500 g/mol to about 45,000 g/mol, or from about 10,000 g/mol to about 34,000 g/mol.

(ii) Preferred graft polymers for the present invention are amphiphilic graft polymers based on water-soluble polyalkylene oxides (A) as a graft base and side chains formed by polymerization of a vinyl ester component (B), said polymers having an average of three, preferably one graft site per 50 alkylene oxide units and mean molar masses Mw of from 3000 to 100 000.

A material within this definition, based on polyethylene oxide of molecular weight 6000 (equivalent to 136 ethylene oxide units), containing approximately 3 parts by weight of vinyl acetate units per 1 part by weight of polyethylene oxide, and having itself a molecular weight of 24 000, is commercially available from BASF as Sokalan (Trade Mark) HP22.

These graft polymers can be prepared by polymerizing a vinyl ester component (B) composed of vinyl acetate and/or vinyl propionate (B1) and, if desired, a further ethylenically unsaturated monomer (B2), in the presence of a water-soluble polyalkylene oxide (A), a free radical-forming initiator (C) and, if desired, up to 40% by weight, based on the sum of components (A), (B) and (C), of an organic solvent (D), at a mean polymerization temperature at which the initiator (C) has a decomposition half-life of from 40 to 500 min, in such a way that the fraction of unconverted graft monomer (B) and initiator (C) in the reaction mixture is constantly kept in a quantitative deficiency relative to the polyalkylene oxide (A).

The graft polymers are characterized by their low degree of branching (degree of grafting). They have, on average, based on the reaction mixture obtained, not more than 1 graft site, preferably not more than 0.6 graft site, more preferably not more than 0.5 graft site and most preferably not more than 0.4 graft site per 50 alkylene oxide units. They comprise, on average, based on the reaction mixture obtained, preferably at least 0.05, in particular at least 0.1 graft site per 50 alkylene oxide units. The degree of branching can be determined, for example, by means of 13C NMR spectroscopy from the integrals of the signals of the graft sites and the —CH2-groups of the polyalkylene oxide.

In accordance with their low degree of branching, the molar ratio of grafted to ungrafted alkylene oxide units in the inventive graft polymers is from 0.002 to 0.05 preferably from 0.002 to 0.035, more preferably from 0.003 to 0.025 and most preferably from 0.004 to 0.02.

(iii) More preferably, the graft polymers feature a narrow molar mass distribution and hence a polydispersity Mw/Mn of generally 3, preferably 2.5 and more preferably 2.3. Most preferably, their polydispersity Mw/Mn is in the range from 1.5 to 2.2. The polydispersity of the graft polymers can be determined, for example, by gel permeation chromatography using narrow-distribution polymethyl methacrylates as the standard.

The mean molecular weight Mw of the graft polymers is from 3000 to 100 000, preferably from 6000 to 45 000 and more preferably from 8000 to 30 000.

Owing to their low degree of branching and their low polydispersity, the amphiphilic character and the block polymer structure of the graft polymers is particularly marked.

The graft polymers also have only a low content of ungrafted polyvinyl ester (B). In general, they comprise 10% by weight, preferably 7.5% by weight and more preferably 5% by weight of ungrafted polyvinyl ester (B).

Owing to the low content of ungrafted polyvinyl ester and the balanced ratio of components (A) and (B), the graft polymers are soluble in water or in water/alcohol mixtures (for example a 25% by weight solution of diethylene glycol monobutyl ether in water). They have pronounced, low cloud points which, for the graft polymers soluble in water at up to 50° C., are generally 95° C., preferably 85° C. and more preferably 75° C., and, for the other graft polymers in 25% by weight diethylene glycol monobutyl ether, generally 90° C., preferably from 45 to 85° C.

The amphiphilic graft polymers have preferably (A) from 20% to 70% by weight of a water-soluble polyalkylene oxide as a graft base and (B) side chains formed by free-radical polymerization of from 30% to 80% by weight of a vinyl ester component composed of (B1) from 70% to 100% by weight of vinyl acetate and/or vinyl propionate and (B2) from 0 to 30% by weight of a further ethylenically unsaturated monomer, in the presence of (A).

More preferably, they comprise from 25% to 60% by weight of the graft base (A) and from 40% to 75% by weight of the polyvinyl ester component (B).

Water-soluble polyalkylene oxides suitable for forming the graft base (A) are in principle all polymers based on C2-C4-alkylene oxides which comprise at least 50% by weight, preferably at least 60% by weight, more preferably at least 75% by weight of ethylene oxide in copolymerized form.

The polyalkylene oxides (A) preferably have a low polydispersity Mw/Mn. Their polydispersity is preferably 1.5.

The polyalkylene oxides (A) may be the corresponding polyalkylene glycols in free form, i.e. with OH end groups, but they may also be capped at one or both end groups. Suitable end groups are, for example, C1-C25-alkyl, phenyl and C1-C14-alkylphenyl groups.

Specific examples of particularly suitable polyalkylene oxides (A) include:

(A1) polyethylene glycols which may be capped at one or both end groups, especially by $C_1$-$C_{25}$-alkyl groups, but are preferably not etherified, and have mean molar masses $M_n$ of preferably from 1500 to 20 000, more preferably from 2500 to 15 000;

(A2) copolymers of ethylene oxide and propylene oxide and/or butylene oxide with an ethylene oxide content of at least 50% by weight, which may likewise be capped at one or both end groups, especially by $C_1$-$C_{25}$-alkyl groups, but are preferably not etherified, and have mean molar masses $M_n$ of preferably from 1500 to 20 000, more preferably from 2500 to 15 000;

(A3) chain-extended products having mean molar masses of in particular from 2500 to 20 000, which are obtainable by reacting polyethylene glycols (A1) having mean molar masses $M_n$ of from 200 to 5000 or copolymers (A2) having mean molar masses $M_n$ of from 200 to 5000 with $C_2$-$C_{12}$-dicarboxylic acids or -dicarboxylic esters or $C_6$-$C_{18}$-diisocyanates.

Preferred graft bases (A) are the polyethylene glycols (A1).

The side chains of the graft polymers are formed by polymerization of a vinyl ester component (B) in the presence of the graft base (A).

The vinyl ester component (B) may consist advantageously of (B1) vinyl acetate or vinyl propionate or of mixtures of vinyl acetate and vinyl propionate, particular preference being given to vinyl acetate as the vinyl ester component (B).

However, the side chains of the graft polymer can also be formed by copolymerizing vinyl acetate and/or vinyl propionate (B1) and a further ethylenically unsaturated monomer (B2). The fraction of monomer (B2) in the vinyl ester component (B) may be up to 30% by weight, which corresponds to a content in the graft polymer of (B2) of 24% by weight.

Suitable comonomers (B2) are, for example, monoethylenically unsaturated carboxylic acids and dicarboxylic acids and their derivatives, such as esters, amides and anhydrides, and styrene. It is of course also possible to use mixtures of different comonomers.

Specific examples include: (meth)acrylic acid, $C_1$-$C_{12}$-alkyl and hydroxy-$C_2$-$C_{12}$-alkyl esters of (meth)acrylic acid, (meth)acrylamide, N—$C_1$-$C_{12}$-alkyl(meth)acrylamide, N,N-di($C_1$-$C_6$-alkyl) (meth)acrylamide, maleic acid, maleic anhydride and mono($C_1$-$C_{12}$-alkyl)esters of maleic acid.

Preferred monomers (B2) are the $C_1$-$C_8$-alkyl esters of (meth)acrylic acid and hydroxyethyl acrylate, particular preference being given to the $C_1$-$C_4$-alkyl esters of (meth)acrylic acid.

Very particularly preferred monomers (B2) are methyl acrylate, ethyl acrylate and in particular n-butyl acrylate.

When the graft polymers comprise the monomers (B2) as a constituent of the vinyl ester component (B), the content of graft polymers in (B2) is preferably from 0.5% to 20% by weight, more preferably from 1% to 15% by weight and most preferably from 2% to 10% by weight.

The graft polymers are advantageously obtainable by polymerizing a vinyl ester component (B) composed of vinyl acetate and/or vinyl propionate (B1) and, if desired, a further ethylenically unsaturated monomer (B2), in the presence of a water-soluble polyalkylene oxide (A), a free radical-forming initiator (C) and, if desired, up to 40% by weight, based on the sum of components (A), (B) and (C), of an organic solvent (D), at a mean polymerization temperature at which the initiator (C) has a decomposition half-life of from 40 to 500 min, in such a way that the fraction of unconverted graft monomer (B) and initiator (C) in the reaction mixture is constantly kept in a quantitative deficiency relative to the polyalkylene oxide (A).

In this process, preference is given to using from 30% to 80% by weight of a vinyl ester component (B) composed of (B1) from 70% to 100% by weight of vinyl acetate and/or vinyl propionate and (B2) from 0 to 30% by weight of a further ethylenically unsaturated monomer and from 20% to 70% by weight of a water-soluble polyalkylene oxide (A) of mean molar mass $M_n$ of from 1500 to 20 000.

The amount of initiator (C) is preferably from 0.2% to 5% by weight, in particular from 0.5% to 3.5% by weight, based in each case on component (B).

For the process, it is essential that the steady-state concentration of radicals present at the mean polymerization temperature is substantially constant and the graft monomer (B) is present in the reaction mixture constantly only in low concentration (for example of not more than 5% by weight). This allows the reaction to be controlled, and graft polymers can be prepared in a controlled manner with the desired low degree of branching and the desired low polydispersity.

The term "mean polymerization temperature" is intended to mean here that, although the process is substantially isothermal, there may, owing to the exothermicity of the reaction, be temperature variations which are preferably kept within the range of +/−10° C., more preferably in the range of +/−5° C.

The free radical-forming initiator (C) at the mean polymerization temperature should have a decomposition half-life of from 40 to 500 min, preferably from 50 to 400 min and more preferably from 60 to 300 min.

The initiator (C) and the graft monomer (B) are advantageously added in such a way that a low and substantially constant concentration of undecomposed initiator and graft monomer (B) is present in the reaction mixture. The proportion of undecomposed initiator in the overall reaction mixture is preferably ≦15% by weight, in particular ≦10% by weight, based on the total amount of initiator metered in during the monomer addition.

The mean polymerization temperature is appropriately in the range from 50° C. to 140° C., preferably from 60° C. to 120° C. and more preferably from 65° C. to 110° C.

Examples of suitable initiators (C) whose decomposition half-life in the temperature range from 50° C. to 140° C. is from 20 to 500 min are:

- O—$C_2$-$C_{12}$-acylated derivatives of tert-$C_4$-$C_{12}$-alkyl hydroperoxides and tert-($C_9$-$C_{12}$-aralkyl) hydroperoxides, such as tert-butyl peroxyacetate, tert-butyl monoperoxymaleate, tert-butyl peroxyisobutyrate, tert-butyl peroxypivalate, tert-butyl peroxyneoheptanoate, tert-butyl peroxy-2-ethylhexanoate, tert-butyl peroxy-3,5,5-trimethylhexanoate, tert-butyl peroxyneodecanoate, tert-amyl peroxypivalate, tert-amyl peroxy-2-ethylhexanoate, tert-amyl peroxyneodecanoate, 1,1,3,3-tetramethylbutyl peroxyneodecanoate, cumyl peroxyneodecanoate, tert-butyl peroxybenzoate, tert-amyl peroxybenzoate and di-tert-butyl diperoxyphthalate;
- di-O—$C_4$-$C_{12}$-acylated derivatives of tert-$C_8$-$C_{14}$-alkylene bisperoxides, such as 2,5-dimethyl-2,5-di(2-ethylhexanoylperoxy)hexane, 2,5-dimethyl-2,5-di(benzoylperoxy)hexane and 1,3-di(2-neodecanoylperoxyisopropyl)benzene;
- di($C_2$-$C_{12}$-alkanoyl) and dibenzoyl peroxides, such as diacetyl peroxide, dipropionyl peroxide, disuccinyl peroxide, dicapryloyl peroxide, di(3,5,5-trimethylhexanoyl)peroxide, didecanoyl peroxide, dilauroyl peroxide, dibenzoyl peroxide, di(4-methylbenzoyl)peroxide, di(4-chlorobenzoyl)peroxide and di(2,4-dichlorobenzoyl)peroxide;
- tert-$C_4$-$C_5$-alkyl peroxy($C_4$-$C_{12}$-alkyl)carbonates, such as tert-amyl peroxy(2-ethylhexyl)carbonate;
- di($C_2$-$C_{12}$-alkyl)peroxydicarbonates, such as di(n-butyl) peroxydicarbonate and di(2-ethylhexyl)peroxydicarbonate.

Depending on the mean polymerization temperature, examples of particularly suitable initiators (C) are:

at a mean polymerization temperature of from 50° C. to 60° C.:

tert-butylperoxyneoheptanoate, tert-butyl peroxyneodecanoate tert-amyl peroxypivalate, tert-amyl peroxyneodecanoate, 1,1,3,3-tetramethylbutyl peroxyneodecanoate, cumyl peroxyneodecanoate, 1,3-di(2-neodecanoyl peroxyisopropyl)benzene, di(n-butyl) peroxydicarbonate and di(2-ethylhexyl)peroxydicarbonate;

at a mean polymerization temperature of from 60° C. to 70° C.:

tert-butyl peroxypivalate, tert-butyl peroxyneoheptanoate, tert-butyl peroxyneodecanoate, tert-amyl peroxypivalate and di(2,4-dichlorobenzoyl)peroxide;

at a mean polymerization temperature of from 70° C. to 80° C.:

tert-butyl peroxypivalate, tert-butyl peroxyneoheptanoate, tert-amyl peroxypivalate, dipropionyl peroxide, dicapryloyl peroxide, didecanoyl peroxide, dilauroyl peroxide, di(2,4-dichlorobenzoyl)peroxide and 2,5-dimethyl-2,5-di(2-ethylhexanoylperoxy)hexane;

at a mean polymerization temperature of from 80° C. to 90° C.:

tert-butyl peroxyisobutyrate, tert-butyl peroxy-2-ethylhexanoate, tert-amyl peroxy-2-ethylhexanoate, dipropionyl peroxide, dicapryloyl peroxide, didecanoyl peroxide, dilauroyl peroxide, di(3,5,5-trimethylhexanoyl)peroxide, dibenzoyl peroxide and di(4-methylbenzoyl)peroxide;

at a mean polymerization temperature of from 90° C. to 100° C.:

tert-butyl peroxyisobutyrate, tert-butyl peroxy-2-ethylhexanoate, tert-butyl monoperoxymaleate, tert-amyl peroxy-2-ethylhexanoate, dibenzoyl peroxide and di(4-methylbenzoyl)peroxide;

at a mean polymerization temperature of from 100° C. to 110° C.:

tert-butyl monoperoxymaleate, tert-butyl peroxy-3,5,5-trimethylhexanoate and tert-amyl peroxy(2-ethylhexyl)carbonate;

at a mean polymerization temperature of from 110° C. to 120° C.:

tert-butyl monoperoxymaleate, tert-butyl peroxy 3,5,5-trimethylhexanoate and tert-amyl peroxy(2-ethylhexyl)carbonate.

Preferred initiators (C) are O—$C_4$-$C_{12}$-acylated derivatives of tert-$C_4$-$C_5$-alkyl hydroperoxides, particular preference being given to tert-butyl peroxypivalate and tert-butyl peroxy-2-ethylhexanoate.

Particularly advantageous polymerization conditions can be established effortlessly by precise adjustment of initiator (C) and polymerization temperature. For instance, the preferred mean polymerization temperature in the case of use of tert-butyl peroxypivalate is from 60° C. to 80° C., and, in the case of tert-butyl peroxy-2-ethylhexanoate, from 80° C. to 100° C.

The inventive polymerization reaction can be carried out in the presence of small amounts of an organic solvent (D). It is of course also possible to use mixtures of different solvents (D). Preference is given to using water-soluble or water-miscible solvents.

When a solvent (D) is used as a diluent, generally from 1% to 40% by weight, preferably from 1% to 35% by weight, more preferably from 1.5% to 30% by weight, most preferably from 2% to 25% by weight, based in each case on the sum of the components (A), (B) and (C), are used.

Examples of suitable solvents (D) include;

monohydric alcohols, preferably aliphatic $C_1$-$C_{16}$-alcohols, more preferably aliphatic $C_2$-$C_{12}$-alcohols, most preferably $C_2$-$C_4$-alcohols, such as ethanol, propanol, isopropanol, butanol, sec-butanol and tert-butanol;

polyhydric alcohols, preferably $C_2$-$C_{10}$-diols, more preferably $C_2$-$C_6$-diols, most preferably $C_2$-$C_4$-alkylene glycols, such as ethylene glycol and propylene glycol;

alkylene glycol ethers, preferably alkylene glycol mono($C_1$-$C_2$-alkyl)ethers and alkylene glycol di($C_1$-$C_6$-alkyl)ethers, more preferably alkylene glycol mono- and di($C_1$-$C_2$-alkyl)ethers, most preferably alkylene glycol mono($C_1$-$C_2$-alkyl)ethers, such as ethylene glycol monomethyl and -ethyl ether and propylene glycol monomethyl and -ethyl ether;

polyalkylene glycols, preferably poly($C_2$-$C_4$-alkylene) glycols having 2-20 $C_2$-$C_4$-alkylene glycol units, more preferably polyethylene glycols having 2-20 ethylene glycol units and polypropylene glycols having 2-10 propylene glycol units, most preferably polyethylene glycols having 2-15 ethylene glycol units and polypropylene glycols having 2-4 propylene glycol units, such as diethylene glycol, triethylene glycol, dipropylene glycol and tripropylene glycol;

polyalkylene glycol monoethers, preferably poly($C_2$-$C_4$-alkylene)glycol mono($C_1$-$C_{25}$-alkyl)ethers having 2-20 alkylene glycol units, more preferably poly($C_2$-$C_4$-alkylene)glycol mono($C_1$-$C_{20}$-alkyl)ethers having 2-20 alkylene glycol units, most preferably poly($C_2$-$C_3$-alkylene)glycol mono($C_1$-$C_{16}$-alkyl)ethers having 3-20 alkylene glycol units;

carboxylic esters, preferably $C_1$-$C_8$-alkyl esters of $C_1$-$C_6$-carboxylic acids, more preferably $C_1$-$C_4$-alkyl esters of $C_1$-$C_3$-carboxylic acids, most preferably $C_2$-$C_4$-alkyl esters of $C_2$-$C_3$-carboxylic acids, such as ethyl acetate and ethyl propionate;

aliphatic ketones which preferably have from 3 to 10 carbon atoms, such as acetone, methyl ethyl ketone, diethyl ketone and cyclohexanone;

cyclic ethers, in particular tetrahydrofuran and dioxane.

The solvents (D) are advantageously those solvents which are also used to formulate the inventive graft polymers for use (for example in washing and cleaning compositions) and can therefore remain in the polymerization product.

Preferred examples of these solvents are polyethylene glycols having 2-15 ethylene glycol units, polypropylene glycols having 2-6 propylene glycol units and in particular alkoxylation products of $C_6$-$C_8$-alcohols (alkylene glycol monoalkyl ethers and polyalkylene glycol monoalkyl ethers).

Particular preference is given here to alkoxylation products of $C_8$-$C_{16}$-alcohols with a high degree of branching, which allow the formulation of polymer mixtures which are free-flowing at 40-70° C. and have a very low polymer content at comparatively low viscosity. The branching may be present in the alkyl chain of the alcohol and/or in the polyalkoxylate moiety (copolymerizatioin of at least one propylene oxide, butylene oxide or isobutylene oxide unit). Particularly suitable examples of these alkoxylation products are 2-ethylhexanol or 2-propylheptanol alkoxylated with 1-15 mol of ethylene oxide, $C_{13}$/$C_{15}$ oxo alcohol or C12/$C_{14}$ or $C_{16}$/$C_{18}$ fatty alcohol alkoxylated with 1-15 mol of ethylene oxide and 1-3 mol of propylene oxide, preference being given to 2-propylheptanol alkoxylated with 1-15 mol of ethylene oxide and 1-3 mol of propylene oxide.

In the process, polyalkylene oxide (A), graft monomer (B1) and, if appropriate, (B2), initiator (C) and, if appropriate, solvent (D) are heated to the selected mean polymerization temperature in a reactor.

The polymerization is carried out in such a way that an excess of polymer (polyalkylene oxide (A) and formed graft polymer) is constantly present in the reactor. The quantitative ratio of polymer to ungratfed monomer and initiator is generally ≧10:1, preferably ≧15:1 and more preferably ≧20:1.

The polymerization process according to the invention can in principle be carried out in various reactor types.

The reactor used is preferably a stirred tank in which the polyalkylene oxide (A), if appropriate together with portions, of generally up to 15% by weight of the particular total amount, of graft monomers (B), initiator (C) and solvent (D), are initially charged fully or partly and heated to the polymerization temperature, and the remaining amounts of (B), (C) and, if appropriate, (D) are metered in, preferably separately. The remaining amounts of (B), (C) and, if appropriate, (D) are metered in preferably over a period of ≧2 h, more preferably of ≧4 h and most preferably of ≧5 h.

In the case of the particularly preferred, substantially solvent-fee process variant, the entire amount of polyalkylene oxide (A) is initially charged as a melt and the graft monomers (B1) and, if appropriate, (B2), and also the initiator (C) present preferably in the form of a from 10 to 50% by weight solution in one of the solvents (D), are metered in, the temperature being controlled such that the selected polymerization temperature, on average during the polymerization, is maintained with a range of especially +/−10° C., in particular +/−5° C.

In a further particularly preferred, low-solvent process variant, the procedure is as described above, except that solvent (D) is metered in during the polymerization in order to limit the viscosity of the reaction mixture. It is also possible to commence with the metered addition of the solvent only at a later time with advanced polymerization, or to add it in portions.

The polymerization can be effected under standard pressure or at reduced or elevated pressure. When the boiling point of the monomers (B) or of any diluent (D) used is exceeded at the selected pressure, the polymerization is carried out with reflux cooling.

Aqueous Liquid Carrier

The liquid detergent compositions herein further contain from 30% to 80% of an aqueous liquid carrier in which the other essential and optional compositions components are dissolved, dispersed or suspended. More preferably the aqueous liquid carrier will comprise from 45% to 70%, more preferable from 45% to 65% of the compositions herein.

One preferred component of the aqueous liquid carrier is water. The aqueous liquid carrier, however, may contain other materials which are liquid, or which dissolve in the liquid carrier, at room temperature (20° C.-25° C.) and which may also serve some other function besides that of an inert filler. Such materials can include, for example, hydrotropes and solvents, discussed in more detail below. Dependent on the geography of use of the liquid detergent composition of the present invention, the water in the aqueous liquid carrier can have a hardness level of about 2-30 gpg ("gpg" is a measure of water hardness that is well known to those skilled in the art, and it stands for "grains per gallon").

pH of the Composition

The liquid detergent composition may have any suitable pH. Preferably the pH of the composition is adjusted to between 4 and 14. More preferably the composition has pH of between 6 and 13, most preferably between 6 and 10. The pH of the composition can be adjusted using pH modifying ingredients known in the art.

Thickness of the Composition

The liquid detergent compositions of the present invention are preferably thickened and have viscosity of greater than 500 cps, when measured at 20° C. More preferably the viscosity of the composition is between 500 and 1100 cps.

Surfactants

A preferred further ingredient of the hand dishwashing composition of the present invention is a surfactant selected from nonionic, anionic, cationic surfactants, ampholytic, zwitterionic, semi-polar nonionic surfactants, and mixtures thereof. Surfactants can be comprised at a level of from 1.0% to 50% by weight, preferably from 5% to 40% by weight, more preferably from 25% to 40% by weight preferably from 30% to 38% by weight of the liquid detergent composition. Non-limiting examples of optional surfactants are discussed below.

High levels of surfactants, in particular high levels of anionic surfactants and/or hydrophobic surfactants, which may be desired for high grease cleaning performance, especially on more hydrophobic greases, cause instability of the dishwashing compositions. High levels of hydrophobic surfactants furthermore cause also suds suppression.

It has been found that the amphiphilic graft polymer of the present invention is highly effective in producing highly effective grease cleaning, especially on more hydrophobic greases, without having to resort to extreme levels (eg above 35-40%) of total surfactant, and/or extreme levels of hydrophilic (C12-C14 chain) anionic surfactant (eg above 25-30%) and/or high levels (eg above 5%) of hydrophobic surfactants (NI surfactants and/or >I4C chain anionic surfactants). Indeed, the addition of the amphiphilic graft polymer of the present invention allows to obtain the same or even better grease cleaning and sudsing performances without the addition of high levels of these surfactants.

Anionic Surfactants

In a preferred embodiment, the composition to be used in the method of the present invention will comprise an anionic surfactant. Preferred anionic surfactants are the sulphate and surlfonate surfactants, more preferred are the alkyl sulphonates and paraffin sulphonates, even more preferred is linear alkyl sulphonate.

Sulphate or Sulphonate Surfactants

The sulphate or sulphonate surfactant is typically present at a level of at least 5%, preferably from 5% to 40% and more preferably from 15% to 30% and even more preferably at 15% to 25% by weight of the liquid detergent composition.

Suitable sulphate or sulphonate surfactants for use in the compositions herein include water-soluble salts or acids of $C_{10}$-$C_{14}$ alkyl or hydroxyalkyl, sulphate or sulphonates. Suitable counterions include hydrogen, alkali metal cation or ammonium or substituted ammonium, but preferably sodium.

Where the hydrocarbyl chain is branched, it preferably comprises $C_{1-4}$ alkyl branching units. The average percentage branching of the sulphate or sulphonate surfactant is preferably greater than 30%, more preferably from 35% to 80% and most preferably from 40% to 60% of the total hydrocarbyl chains.

The sulphate or sulphonate surfactants may be selected from $C_{11}$-$C_{18}$ alkyl benzene sulphonates (LAS), $C_8$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. No. 6,020,303 and U.S. Pat. No. 6,060,443; mid-chain branched alkyl alkoxy sulphates as discussed in U.S. Pat. No. 6,008,181 and U.S. Pat. No. 6,020,303; modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS).

The paraffin sulphonates may be monosulphonates or disulphonates and usually are mixtures thereof, obtained by sulphonating paraffins of 10 to 20 carbon atoms. Preferred sulphonates are those of C12-18 carbon atoms chains and more preferably they are C14-17 chains. Paraffin sulphonates that have the sulphonate group(s) distributed along the paraffin chain are described in U.S. Pat. No. 2,503,280; U.S. Pat. No. 2,507,088; U.S. Pat. No. 3,260,744; U.S. Pat. No. 3,372,188 and in DE 735 096.

Alkyl glyceryl sulphonate surfactants and/or alkyl glyceryl sulphate surfactants generally used have high monomer content (greater than 60 wt % by weight of the alkyl glycerol sulphonate surfactant). As used herein "oligomer" includes dimer, trimer, quadrimer, and oligomers up to heptamers of alkyl glyceryl sulphonate surfactant and/or alkyl glyceryl sulphate surfactant. Minimization of the monomer content may be from 0 wt % to about 60 wt %, from 0 wt % to about 55 wt %, from 0 wt % to about 50 wt %, from 0 wt % to about 30 wt %, by weight of the alkyl glyceryl sulphonate surfactant and/or alkyl glyceryl sulphate surfactant present.

The alkyl glyceryl sulphonate surfactant and/or alkyl glyceryl sulphate surfactant for use herein include such surfactants having an alkyl chain length from $C_{10-40}$, $C_{10-22}$, $C_{12-18}$, and $C_{16-18}$. The alkyl chain may be branched or linear, wherein when present, the branches comprise a $C_{1-4}$ alkyl moiety, such as methyl ($C_1$) or ethyl ($C_2$). Generally, the structures of suitable alkyl glyceryl sulphonate surfactant oligomers that may be used herein include (A) dimers; (B) trimers, and (C) tetramers:

(A)

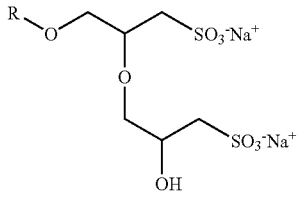

(B)

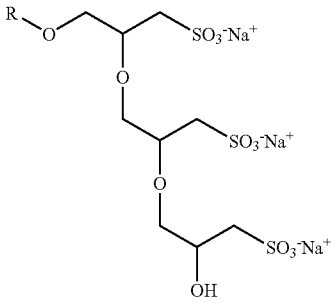

(C)

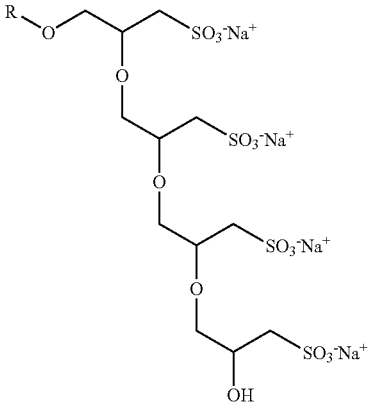

One of skill in the art will recognize that the counter-ion may be substituted with other suitable soluble cations other than the sodium shown above. R in the above structures (A)-(C) is from $C_{10-40}$, $C_{10-22}$, $C_{12-18}$, and $C_{16-18}$. The alkyl chain may be branched or linear, wherein when present, the branches comprise a $C_{1-4}$ alkyl moiety, such as methyl ($C_1$) or ethyl ($C_2$). One of skill in the art will also recognize that the corresponding alkyl glyceryl sulphate surfactant oligomers may also have similar structures with the $SO_3^-$ moiety being an $OSO_3^-$ moiety.

The alkyl glyceryl sulphonate surfactant and/or alkyl glyceryl sulphate surfactant oligomer content may be between 40 wt % and 100 wt %, 45 wt % and 100 wt %, 50 wt % and 100 wt %, 70 wt % and 100 wt % by weight of the alkyl glycerol sulphonate surfactant and/or alkyl glyceryl sulphate surfactant. As used herein, the "oligomer content" means the sum of the alkyl glyceryl sulphonate surfactant oligomers and/or alkyl glyceryl sulphate surfactant oligomers, such as dimers, trimers, quadrimers, and above (heptamers) present in the alkyl glyceryl sulphonate surfactant and/or alkyl glyceryl sulphate surfactant. More specifically, as shown below in Table I, nonlimiting examples of alkyl glyceryl sulphonate surfactant oligomer content demonstrates the weight percent of oligomers present and the minimization of the monomer content of the alkyl glyceryl sulphonate surfactant. The alkyl glyceryl sulphonate surfactant is optionally present at a level of at least 10%, more preferably from 10% to 40% and most preferably from 10% to 30% by weight of the composition.

Dialkylsulfosuccinates

An optional component used in the liquid detergent composition of the present invention is dialkyl sulfosuccinates. The dialkyl sulfosuccinates may be a $C_{6-15}$ linear or branched dialkyl sulfosuccinate. The alkyl moieties may be symmetrical (i.e., the same alkyl moieties) or asymmetrical (i.e., different alkyl moieties). Preferably, the alkyl moiety is symmetrical. The dialkyl sulfosuccinates may be present in the liquid detergent composition from 0.5% to 10% by weight of the composition.

Nonionic Surfactants

Nonionic surfactants are generally considered as hydrophobic surfactants. Nonionic surfactant, when present, is comprised in a typical amount of from 0.1 to 20%, preferably 0.5% to 10% by weight of the liquid detergent composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from 2 to 18 moles of ethylene oxide per mole of alcohol.

The number of mole of ethylene oxide per mole of alcohol is usually between 2 and 6 for more hydrophobic nonionic surfactants. Most suitable hydrophobic surfactants for grease cleaning are the solubilising nonionic surfactants described in US 2005/0107275 published on May 19, 2005 by the Procter & Gamble Company, pages 2-3, paragraphs [0018] to [0031].

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose.

Also suitable are fatty acid amide surfactants having the formula (IV):

$$R^6\overset{\overset{\displaystyle O}{\|}}{C}N(R^7)_2 \qquad \text{(IV)}$$

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and —$(C_2H_4O)_xH$ where x of formula (IV) varies from 1 to 3. Preferred amides are $C_8$-$C_{20}$ ammonia amides, monoethanolamides, diethanolamides, and ispropanolamides.

Cationic Surfactants

Cationic surfactants, when present in the composition, are present in an effective amount, more preferably from 0.1% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyethyl or hydroxypropyl groups. Another preferred cationic surfactant is an $C_6$-$C_{18}$ alkyl or alkenyl ester of a quaternary ammonium alcohol, such as quaternary chlorine esters. More preferably, the cationic surfactants have the formula (V):

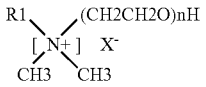

(V)

wherein R1 of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and X of formula (V) is an anion, preferably, chloride or bromide.

Amine Oxide-Surfactants

Preferred ingredients for the liquid detergent compositions are amine oxides surfactants which typically herein may be comprised at a level of from 0.1% to 15% by weight, preferably from 3.0% to 10% by weight of the liquid detergent composition. The amine oxide may have a linear or mid-branched alkyl moiety.

Linear amine oxides, for optional use herein, include water-soluble amine oxides containing one $C_{8-18}$ alkyl moiety and 2 moieties selected from the group consisting of $C_{1-3}$ alkyl groups and $C_{1-3}$ hydroxyalkyl groups; water-soluble phosphine oxides containing one $C_{10-18}$ alkyl moiety and 2 moieties selected from the group consisting of $C_{1-3}$ alkyl groups and $C_{1-3}$ hydroxyalkyl groups; and water-soluble sulfoxides containing one $C_{10-18}$ alkyl moiety and a moiety selected from the group consisting of $C_{1-3}$ alkyl and $C_{1-3}$ hydroxyalkyl moieties.

Preferred amine oxide surfactants have formula (VI):

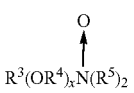

(VI)

wherein $R^3$ of formula (VI) is an linear $C_{8-22}$ alkyl, linear $C_{8-22}$ hydroxyalkyl, $C_{8-22}$ alkyl phenyl group, and mixtures thereof; $R^4$ of formula (VI) is an $C_{2-3}$ alkylene or $C_{2-3}$ hydroxyalkylene group or mixtures thereof; x is from 0 to about 3; and each $R^5$ of formula (VI) is an $C_{1-3}$ alkyl or $C_{1-3}$ hydroxyalkyl group or a polyethylene oxide group containing an average of from about 1 to about 3 ethylene oxide groups. The $R^5$ groups of formula (VI) may be attached to each other, e.g., through an oxygen or nitrogen atom, to form a ring structure.

The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides.

As used herein "mid-branched" means that the amine oxide has one alkyl moiety having $n_1$ carbon atoms with one alkyl branch on the alkyl moiety having $n_2$ carbon atoms. The alkyl branch is located on the a carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Ampholytic Surfactants

Other suitable, non-limiting examples of amphoteric detergent surfactants that are optional in the present invention include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group. Typically, when present, ampholytic surfactants comprise from about 0.01% to about 20%, preferably from about 0.5% to about 10% by weight of the liquid detergent composition.

Alkoxylated Polyethyleneimine Polymer

In a preferred embodiment, the composition used in the method of the present invention will further comprise one or more alkoxylated polyethyleneimine polymer. It has been found that such an alkoxylated polyethyleneimine polymer provides an improvement in suds mileage both in soft and hard water. Therefore, when combined with the polymer of the present invention, a much stronger suds performance profile across water hardnesses is observed. The combination of the 2 polymers further provides excellent grease cleaning especially through the broad range of regular to baked-on grease.

The composition to be used in the method of the present invention, may comprise from 0.01 wt % to 10 wt %, preferably from 0.01 wt % to 2 wt %, more preferably from 0.1 wt % to 1.5 wt %, even more preferable from 0.2% to 1.5% by weight of the composition of an alkoxylated polyethyleneimine polymer.

The alkoxylated polyethyleneimine polymer of the present composition has a polyethyleneimine backbone having from about 400 to about 10000 weight average molecular weight, preferably from about 400 to about 7000 weight average molecular weight, alternatively from about 3000 to about 7000 weight average molecular weight.

These polyamines can be prepared for example, by polymerizing ethyleneimine in presence of a catalyst such as carbon dioxide, sodium bisulfite, sulfuric acid, hydrogen peroxide, hydrochloric acid, acetic acid, and the like.

The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety or benzyl moiety and one or two alkoxylation modifications per nitrogen atom, dependent on whether the substitution occurs at a internal nitrogen atom or at an terminal nitrogen atom, in the polyethyleneimines backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

For example, but not limited to, below is shown possible modifications to terminal nitrogen atoms in the polyethyleneimine backbone where R represents an ethylene spacer and E represents a $C_1$-$C_4$ alkyl moiety or a benzyl moiety and $X^-$ represents a suitable water soluble counterion.

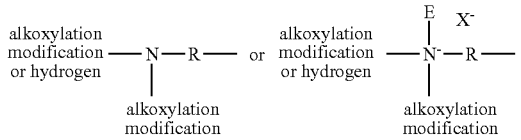

Also, for example, but not limited to, below is shown possible modifications to internal nitrogen atoms in the polyethyleneimine backbone where R represents an ethylene spacer and E represents a $C_1$-$C_4$ alkyl moiety and X— represents a suitable water soluble counterion.

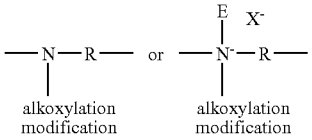

The alkoxylation modification of the polyethyleneimine backbone consists of the replacement of a hydrogen atom by a polyalkoxylene chain having an average of about 1 to about 30 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. Preferably, the polyalkoxylene chain is selected from ethoxy moieties and ethoxy/propoxy block moieties. More preferably, the polyalkoxylene chain is ethoxy moieties in an average degree of from about 5 to about 15 and the polyalkoxylene chain is ethoxy/propoxy block moieties having an average degree of ethoxylation from about 5 to about 15 and an average degree of propoxylation from about 1 to about 16. Most preferable the polyalkoxylene chain is the ethoxy/propoxy block moieties wherein the propoxy moiety block is the terminal alkoxy moiety block.

Additionally, one may quaternize the polyethyleneimine backbone nitrogen atoms with alkylating agent such as alkyl sulfates, alkyl halides, benzyl sulfates, or benzyl halides resulting in permanent quaternisation. The degree of permanent quaternization may be from 0% to about 30% and even 60% of the polyethyleneimine backbone nitrogen atoms. It is preferred to have less than 30% of the polyethyleneimine backbone nitrogen atoms permanently quaternized.

A preferred modified polyethyleneimine has the general structure of formula (I):

formula (I)

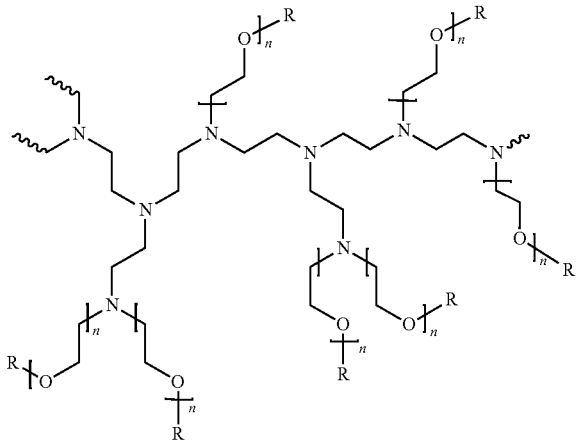

wherein the polyethyleneimine backbone has a weight average molecular weight of 600 or 5000, n of formula (I) has an average of 5-10 and R of formula (I) is selected from hydrogen, a $C_1$-$C_4$ alkyl and mixtures thereof.

Another preferred polyethyleneimine has the general structure of formula (II):

formula (II)

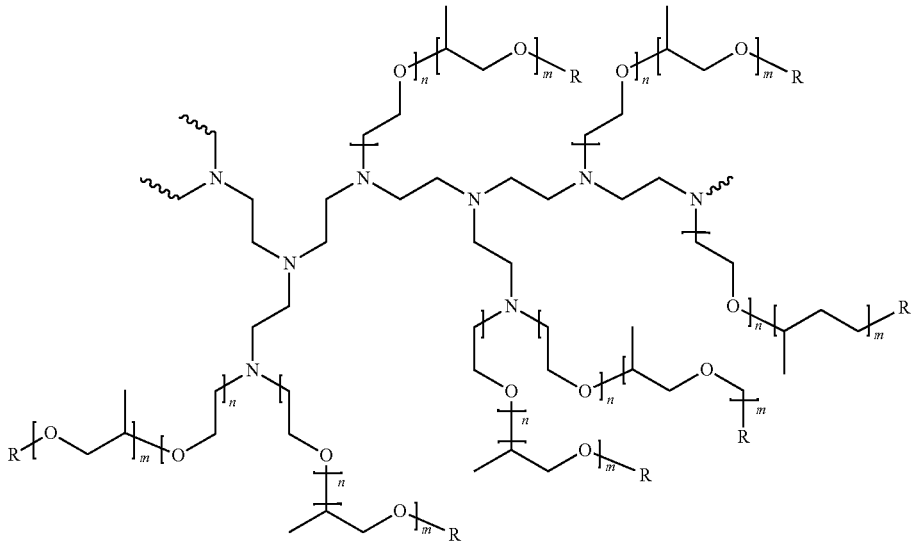

wherein the polyethyleneimine backbone has a weight average molecular weight of either 600 or 5000, n of formula (II) has an average of 10, m of formula (II) has an average of 7 and R of formula (II) is selected from hydrogen, a $C_1$-$C_4$ alkyl and mixtures thereof. The degree of permanent quaternization of formula (II) may be from 0% to about 30%, preferably to 22% of the polyethyleneimine backbone nitrogen atoms.

Example 1

Polyethyleneimine (backbone molecular weight 5000) hereinafter PEI 5000 with 7 exthoxy moieties (EO) per nitrogen of the polyethyleneimine backbone (NH)

a) Treatment of PEI 5000 with 1 EO/NH

Heat to 80° C. in a 2 L reactor 900 g of a 50 wt % aqueous solution of PEI 5000 (backbone molecular weight 5000) and strip with nitrogen thrice (until a pressure of 500 kPa (5 bar) is obtained). Increase the temperature to 90° C. and add 461 g ethylene oxide until pressure rises to 500 kPa (5 bar). Remove the volatile components after 2 hours by stripping with nitrogen at 80° C. or vacuum of 50 kPa (500 mbar) at 80° C. Collect 1345 g of a 68% aqueous solution, which contains PEI 5000 with 1 EO/NH b) Alkoxylation in the Presence of a Solvent Treat in a 2 l reactor 362 g of a 68.5% aqueous solution from step (a) with 31 g of 40% aqueous solution of potassium hydroxide and 300 g xylene and and strip with nitrogen thrice (until a pressure of 500 kPa (5 bar) is obtained). Remove water during a 4 hour time period at 170° C. (under ascription of solvent). Add 753 g ethylene oxide at 120° C. until pressure of 300 kPa (3 bar) is obtained. Stir for 3 hours at 120° C. Remove the solvent from the compound and strip with a water steam at 120° C. for 3 hours. Collect 1000 g of a bright brownish viscous liquid (amine. 2.5448 mmol KOH/g; pH value 1% ig in water 11.2), which is the desired product (PEI 5000-7 EO/NH).

Example 2

Polyethyleneimine (backbone molecular weight 5000) hereinafter PEI 5000 with 10 exthoxy moieties (EO) and 7 propoxy moieties (PO) per nitrogen of the polyethyleneiminie backbone (NH)

a) Treatment of PEI 5000 with 1 EO/NH as in Example 1.

b) Alkoxylation

Treat in a 2 l reactor 163 g of a 68.4% the aqueous solution from step (a) with 13.9 g of 40% an aqueous solution of potassium hydroxide, heat to 70° C. and strip with nitrogen thrice (until a pressure of 500 kPa (5 bar) is obtained). Remove water during a 4 hour time period at 120° C. and vacuum of 1 kPa (10 mbar). Add 506 g ethylene oxide at 120° C. until pressure of 800 kPa (8 bar) is obtained. Stir for 4 hours at 120° C. Strip with nitrogen 120° C. Add 519 g propylene oxide at 120° C. until pressure of 800 kPa (8 bar) is obtained. Stir for 4 hours at 102° C. Remove volatile components by stripping with nitrogen at 80° C. or vacuum of 50 kPa (500 mbar) at 80° C. Collect 1178 g of a bright brownish viscous liquid (amine titer, 0.9276 mmol KOH/g; pH value 1% ig in water 10.67) which is the desired product (PEI 5000-10 EO/NH-7 PO/NH).

OR

Alternative b) Alkoxylation in the Presence of a Solvent

Treat in a 2 l reactor 137 g of a 68.7% the aqueous solution from (a) with 11.8 g of 40% aqueous solution of potassium hydroxide and 300 g xylene and strip with nitrogen thrice (until pressure of 500 kPa (5 bar)). Remove the water present over the next 4 hours while maintaining a temperature of 170° C. (under ascription of solvent). Add 428 g of ethylene oxide at 120° C. until pressure of 300 kPa (3 bar) is obtained and stir for 2 hours at 120° C. Strip with nitrogen at 120° C. Add 439 g propylene oxide at 120° C. until pressure of 300 kPa (3 bar) is obtained. Stir for 3 hours at 120° C. Remove the solvent from the compound and strip with a water steam at 120° C. for 3 hours. Collect 956 g of a bright brownish viscous liquid (amine titer: 0.9672 mmol KOH/g; pH value 1% ig in water 10.69), which is the desired product (PEI 5000-10 EO/NH-7 PO/NH).

Example 3

Polyethyleneimine (backbone molecular weight 5000) hereinafter PEI5000 with 10 exthoxy moieties (EO) and 7 propoxy moieties (PO) per nitrogen of the polyethyleneiminie backbone (NH) with 22% quaternization Prepare PEI 5000 EO10 PO7 as shown in the example 2 a) Quaternization 300 g of PEI5000-10 EO/NH-7 PO/NH (example 2) under nitrogen atmosphere were heated to 60° C. Subsequent 7.3 g dimethyl sulfate were dropwise added. Temperature rose to 70° C. and the mixture was stirred for 3 h. Reduction of amine titer (from 0.9672 mmol/g to 0.7514 mmol/g) showed a quaternion of 22% of N. 307 g of a brownish, viscous liquid are received, which is PEI 5000-(10 EO-7 PO)/NH-22% quatted.

Example 4

Polyethyleneimine (backbone molecular weight 600) hereinafter PEI600 with 10 exthoxy moieties (EO) and 7 propoxy moieties (PO) per nitrogen of the polyethyleneiminie backbone (NH)

a) Treatment of PEI 600 with 1 EO/NH

In a 2 l reactor 516 g of polyethyleneimine 600 (molecular weight 600 g/mol) and 10.3 g water were stripped with nitrogen thrice (until pressure of 5 bar) and heated to 90° C. At 90° C. 528 g ethylene oxide were added. After 1 h stirring at 90° C. 1050 g of a liquid are received. Volatile components are removed by stripping with nitrogen or vacuum of 10 mbar at 90° C. The liquid contains PEI 600 with 1 EO/NH.

b) Alkoxylation

In a 2 l reactor 86 g of a liquid from a) were treated with 10.8 g of 40% aqueous solution of KOH, heated to 80° C. and stripped with nitrogen thrice (until pressure of 5 bar). Water was removed during 2.5 h at 120° C. and vacuum of 10 mbar. Subsequent reactor was flushed with nitrogen and 384 g ethylene oxide were added at 120° C. and 2 h stirred at this temperature afterwards. Afterwards at 120° C. 393 g propylene oxide were added at 120° C. and 2 h stirred at this temperature. Volatile components are removed by stripping with nitrogen or vacuum of 500 mbar at 80° C. 865 g of a bright brownish viscous liquid are received (amine titer: 1.0137 mmol/g; pH value 1%/ig in water 11.15), which is the desired product (PEI 600-10 EO/NH-7 PO/NH).

Magnesium Ions

The optional presence of magnesium ions may be utilized in the detergent composition when the compositions are used in softened water that contains few divalent ions. When utilized, the magnesium ions preferably are added as a hydroxide, chloride, acetate, sulphate, formate, oxide or nitrate salt to the compositions of the present invention. When included, the magnesium ions are present at an active level of from 0.01% to 1.5%, preferably from 0.015% to 1%, more preferably from 0.025% to 0.5%, by weight of the liquid detergent composition.

Solvent

The present compositions may optionally comprise a solvent. Suitable solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. When present, the liquid detergent composition will contain from 0.01% to 20%, preferably from 0.5% to 20%, more preferably from 1% to 10% by weight of the liquid detergent composition of a solvent. These solvents may be used in conjunction with an aqueous liquid carrier, such as water, or they may be used without any aqueous liquid carrier being present.

Hydrotrope

The liquid detergent compositions of the invention may optionally comprise a hydrotrope in an effective amount so that the liquid detergent compositions are appropriately compatible in water. Suitable hydrotropes for use herein include anionic-type hydrotropes, particularly sodium, potassium, and ammonium xylene sulphonate, sodium, potassium and ammonium toluene sulphonate, sodium potassium and ammonium cumene sulphonate, and mixtures thereof, and related compounds, as disclosed in U.S. Pat. No. 3,915,903. The liquid detergent compositions of the present invention typically comprise from 0% to 15% by weight of the liquid detergent composition of a hydrotropic, or mixtures thereof, preferably from 1% to 10%, most preferably from 3% to 6% by weight.

Polymeric Suds Stabilizer

The compositions of the present invention may optionally contain a polymeric suds stabilizer. These polymeric suds stabilizers provide extended suds volume and suds duration of the liquid detergent compositions. These polymeric suds stabilizers may be selected from homopolymers of (N,N-dialkylamino) alkyl esters and (N,N-dialkylamino) alkyl acrylate esters. The weight average molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt, for example the citrate, sulphate, or nitrate salt of (N,N-dimethylamino)alkyl acrylate ester.

One preferred polymeric suds stabilizer is (N,N-dimethylamino)alkyl acrylate esters, namely the acrylate ester represented by the formula (VII):

(VII)

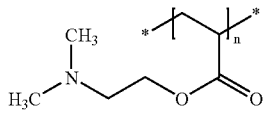

When present in the compositions, the polymeric suds booster may be present in the composition from 0.01% to 15%, preferably from 0.05% to 10%, more preferably from 0.1% to 5%, by weight of the liquid detergent composition.

Diamines

Another optional ingredient of the compositions according to the present invention is a diamine. Since the habits and practices of the users of liquid detergent compositions show considerable variation, the composition will preferably contain 0% to 15%, preferably 0.1% to 15%, preferably 0.2% to 10%, more preferably 0.25% to 6%, more preferably 0.5% to 1.5% by weight of said composition of at least one diamine.

Preferred organic diamines are those in which pK1 and pK2 are in the range of 8.0 to 11.5, preferably in the range of 8.4 to 11 even more preferably from 8.6 to 10.75. Preferred materials include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EP®) (pK1=10.5; pK2=8.9), 2-methyl 1,5 pentane diamine (DYTEK A®) (pK1=11.2; pK2=10.0). Other preferred materials include primary/primary diamines with alkylene spacers ranging from $C_4$ to $C_8$. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by DUPONT®, a supplier of diamines. As a working definition herein, the pKa of the diamines is specified in an all-aqueous solution at 25° C. and for an ionic strength between 0.1 to 0.5 M.

Carboxylic Acid

The liquid detergent compositions according to the present invention may comprise a linear or cyclic carboxylic acid or salt thereof to improve the rinse feel of the composition. The presence of anionic surfactants, especially when present in higher amounts in the region of 15-35% by weight of the composition, results in the composition imparting a slippery feel to the hands of the user and the dishware. This feeling of slipperiness is reduced when using the carboxylic acids as defined herein i.e. the rinse feel becomes draggy.

Carboxylic acids useful herein include $C_{1-6}$ linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof, when present, is preferably present at the level of from 0.1% to 5%, more preferably from 0.2% to 1% and most preferably from 0.25% to 0.5%.

Preferably, the liquid detergent compositions herein are formulated as clear liquid compositions. By "clear" it is meant stable and transparent. In order to achieve clear compositions, the use of solvents and hydrotropes is well known to those familiar with the art of light-duty liquid dishwashing compositions. Preferred liquid detergent compositions in accordance with the invention are clear single phase liquids, but the invention also embraces clear and opaque products containing dispersed phases, such as beads or pearls as described in U.S. Pat. No. 5,866,529, to Erilli, et al., and U.S. Pat. No. 6,380,150, to Toussaint, et al., provided that such products are physically stable (i.e., do not separate) on storage.

The liquid detergent compositions of the present invention may be packages in any suitable packaging for delivering the liquid detergent composition for use. Preferably the package is a clear package made of glass or plastic.

Other Optional Components:

The liquid detergent compositions herein can further comprise a number of other optional ingredients suitable for use in liquid detergent compositions such as perfume, dyes, opacifiers, enzymes, chelants, thickening agents and pH buffering means so that the liquid detergent compositions herein generally have a pH of from 4 to 14, preferably 6 to 13, most preferably 6 to 10. A further discussion of acceptable optional ingredients suitable for use in light-duty liquid detergent composition may be found in U.S. Pat. No. 5,798,505.

Viscosity Test Method

The viscosity of the composition of the present invention is measured on a Brookfield viscometer model # LVDVII+ at 20° C. The spindle used for these measurements is S31 with the appropriate speed to measure products of different viscosities; e.g., 12 rpm to measure products of viscosity greater than 1000 cps, 30 rpm to measure products with viscosities between 500 cps-1000 cps; 60 rpm to measure products with viscosities less than 500 cps.

EXAMPLES

TABLE A

Light-Duty Liquid Dishwashing Detergent Composition

| Composition | A | B | C | D | E | F | G | H | I |
|---|---|---|---|---|---|---|---|---|---|
| $C_{12-13}$ AExS[1] | 29.0 | 26.0 | 26.0 | 26.0 | 29.0 | 29.0 | 15.0 | 5.0 | 15.0 |
| $C_{10-14}$ Amine Oxide | 6.0 | 6.0 | 6.0 | 6.0 | 6.0 | 6.0 | 5.0 | 1.0 | 5.0 |
| $C_{11}E_9$ Nonionic[2] | — | 2.0 | 2.0 | — | — | — | — | 2.0 | — |
| LAS | — | — | 2.0 | — | — | — | 14.0 | 13.0 | 14.0 |
| PEG-grafted PVAc[6] | 0.1 | 0.5 | 1.0 | 2.0 | 1.0 | 1.0 | 1.0 | 0.5 | 1.0 |
| Solvents including Ethanol, NaCl and/or polypropylene glycol | 3.5 | 2.8 | 3.5 | 2.8 | 3.5 | 3.5 | 5.5 | 3.0 | 5.5 |
| 1,3 BAC Diaminc[3] | 0.2 | 0.2 | 0.2 | 0.2 | 0.2 | 0.2 | — | — | — |
| Suds boosting polymer[4] | 0.1 | 0.1 | 0.1 | 0.1 | 0.1 | 0.1 | — | — | — |
| alkoxylated polyethyleneimine polymer[5] | — | 1.0 | — | — | — | 0.8 | — | — | 0.8 |
| Water and minors | Balance | | | | | | | | |

[1] $C_{12-13}$ alkyl ethoxy sulphonate containing an average of 0.5-3 ethoxy groups.

[2] Nonionic may be either $C_{11}$ Alkyl ethoxylated surfactant containing 9 ethoxy groups or C10 alkly ethoxylated surfactant containing 8 ethoxy groups.

[3] 1,3, BAC is 1,3 bis(methylamine)-cyclohexane.

[4] (N,N-dimethylamino)ethyl methacrylate homopolymer.

[5] alkoxylated polyethyleneimine polymer, PEI600 with 10 exthoxy moieties (EO) and 7 propoxy moieties (PO) per nitrogen of the polyethyleneiminie backbone (NH) (example 4) and/or a polymer as described above in examples 1-3.

[6] An amphiphilic graft polymer or any mixture of polymers as defined below (i) to (iii) or exemplified acording to any of following Examples 1, 2, 3, 4, 5 or 6 below.

(i) A 6,000 g/mol Mw polyethylene glycol backbone grafted at 70° C. with 60% vinyl acetate by weight of the resulting polymer.

(ii) A 6,000 g/mol Mw polyethylene glycol backbone grafted at 70° C. with 60% vinyl acetate by weight of the resulting polymer, and 40% of ester links hydrolyzed.

(iii) A 12,000 g/mol Mw polyethylene glycol backbone grafted at 70° C. with 54% vinyl acetate and 6% butyl acrylate by weight of the resulting polymer.

The following 6 amphiphilic graft polymers may be prepared as follows. The K values may be measured in 3% by weight aqueous NaCl solution at 23° C. and a polymer concentration of 1% by weight. The mean molar masses and polydispersities are determined by gel permeation chromatography using a 0.5% by weight LiBr solution in dimethylacetamide as the eluent and of polymethyl methacrylate (PMMA) as the standard. The degrees of branching may be determined by $^{13}C$ NMR spectroscopy in deuterated dimethyl sulfoxide from the integrals of the signals of the graft sites and the —$CH_2$-groups of the polyethylene glycol. The values reported relate to all of the polyethylene glycol present in the product, i.e. including ungrafted polyethylene glycol, and correspond to the number of side chains present on average per polyethylene glycol.

Graft Polymer 1

A polymerization vessel equipped with stirrer and reflux condenser is initially charged with 480 g of polyethylene glycol ($M_n$ 12,000) under a nitrogen atmosphere and melted at 70° C.

After addition of 16.0 g of vinyl acetate and 0.2 g of tert-butyl peroxypivalate, dissolved in 0.9 g of dipropylene glycol, and stirring for a further 5 minutes, 304 g of vinyl acetate within 6 h (feed 1) and 4.0 g of tert-butyl peroxypivalate, dissolved in 18 g of dipropylene glycol, within 7 h (feed 2) are metered in in parallel continuously with constant flow rates at internal temperature 70° C. with stirring.

After feed 2 has ended and the mixture has been stirred at 70° C. for a further hour, 4.8 g of tert-butyl peroxypivalate, dissolved in 9.0 g of dipropylene glycol, are added in 3 portions at 70° C. with further stirring for two hours in each case. In addition, 73 g of dipropylene glycol are added to lower the viscosity.

Residual amounts of vinyl acetate are removed by vacuum distillation at 70° C. Subsequently a solids content of 24.3% by weight is established by adding water.

The resulting graft polymer has a K value of 28.4, a polydispersity of 1.8 (weight average molecular weight, $M_w$, 36,900, and number average molecular weight, $M_n$, 21,000) and a degree of branching of 0.8%. (corresponds to 0.15 graft site/50 EO units).

Graft Polymer 2

A polymerization vessel equipped with stirrer and reflux condenser is initially charged with 400 g of polyethylene glycol ($M_n$ 9000) under a nitrogen atmosphere and melted at 85° C.

After addition of 20.0 g of vinyl acetate and 0.25 g of tert-butyl peroxy-2-ethylhexanoate, dissolved in 0.9 g of dipropylene glycol, and stirring for a further 5 minutes, 380 g of vinyl acetate within 6 h (feed 1) and 5.0 g of tert-butyl peroxy-2-ethylhexanoate, dissolved in 18 g of dipropylene glycol, within 7 h (feed 2) are metered in in parallel continuously with constant flow rates at internal temperature 85° C. with stirring.

After feed 2 has ended and the mixture has been stirred at 85° C. for a further hour, 6.0 g of tert-butyl peroxy-2-ethylhexanoate, dissolved in 9.0 g of dipropylene glycol, are added in 3 portions at 85° C. with further stirring for two hours in each case. In addition, 73 g of dipropylene glycol are added to lower the viscosity.

Residual amounts of vinyl acetate are removed by vacuum distillation at 85° C. Subsequently, a solids content of 23.2% by weight is established by adding water.

The resulting graft polymer has a K value of 24.0, a polydispersity of 1.9 ($M_w$ 37 000, $M_n$ 19 500) and a degree of branching of 0.8% (corresponds to 0.20 graft site/50 EO units).

Graft Polymer 3

A polymerization pressure vessel equipped with stirrer and reflux condenser is initially charged with 1000 g of polyethylene glycol ($M_n$ 6000 under a nitrogen atmosphere and melted at 90° C.

Then, 1500 g of vinyl acetate within 6 h (feed 1) and 14.5 g of tert-butyl peroxy-2-ethylhexanoate, dissolved in 60.5 g of tripropylene glycol, within 7 h (feed 2) are metered in parallel continuously with constant flow rates at internal temperature 90° C. with stirring.

After feed 2 has ended and the mixture has been stirred at 90° C. for a further hour, 17.1 g of tert-butyl peroxy-2-ethylhexanoate, dissolved in 22.6 g of tripropylene glycol, are added in 3 portions at 90° C. with further stirring for two hours in each case. In addition, 73 g of dipropylene glycol are added to lower the viscosity.

Residual amounts of vinyl acetate are removed by vacuum distillation at 90° C. Subsequently, a solids content of 22.8% by weight is established by adding water.

The resulting graft polymer has a K value of 19.6, a polydispersity of 1.9 ($M_w$ 35,700, $M_n$ 18,800) and a degree of branching of 0.9% (corresponds to 0.33 graft site/50 EO units).

Graft Polymer 4

A polymerization vessel equipped with stirrer and reflux condenser is initially charged with 480 g of polyethylene glycol ($M_n$ 12,000) under a nitrogen atmosphere and melted at 70° C.

After addition of 14.0 g of vinyl acetate, 1.6 g of butyl acrylate and 0.3 g of tert-butyl peroxypivalate, dissolved in 0.9 g of dipropylene glycol, and stirring for a further 5 minutes, 274 g of vinyl acetate within 6 h (feed 1), 30.4 g of butyl acrylate within 6 h (feed 2) and 6.0 g of tert-butyl peroxypivalate, dissolved in 18 g of dipropylene glycol, within 7 h (feed 3) are metered in in parallel continuously with constant flow rates at internal temperature 70° C. with stirring.

After feed 3 has ended and the mixture has been stirred at 70° C. for a further hour, 7.2 g of tert-butyl peroxypivalate, dissolved in 9.0 g of dipropylene glycol, are added in 3 portions at 70° C. with further stirring for two hours in each case. In addition, 73 g of dipropylene glycol are added to lower the viscosity.

Residual amounts of monomer are removed by vacuum distillation at 70° C. Subsequently, a solids content of 19.8% by weight is established by adding water.

The resulting graft polymer has a K value of 29.1, a polydispersity of 1.9 ($M_w$ 35,500, $M_n$ 18,400) and a degree of branching of 0.7% (corresponds to 0.13 graft site/50 EO units).

Graft Polymer 5

A polymerization pressure vessel equipped with stirrer and reflux condenser is initially charged with 1175 g of polyethylene glycol ($M_n$ 4000) under a nitrogen atmosphere and melted at 90° C.

After addition of 88.0 g of vinyl acetate and 0.85 g of tert-butyl peroxy-2-ethylhexanoate, dissolved in 3.5 g of tripropylene glycol, and stirring for a further 5 minutes, 1674 g of vinyl acetate within 6 h (feed 1) and 17.0 g of tert-butyl peroxy-2-ethylhexanoate, dissolved in 71 g of tripropylene glycol, within 7 h (feed 2) are metered in in parallel continuously with constant flow rates at internal temperature 90° C. with stirring.

After feed 2 had ended and the mixture has been stirred at 90° C. for a further hour, 39.0 g of tert-butyl peroxy-2-ethylhexanoate, dissolved in 21.0 g of tripropylene glycol, are added in 3 portions at 70° C. with further stirring for two hours in each case. In addition, 73 g of dipropylene glycol are added to lower the viscosity.

Residual amounts of vinyl acetate are removed by vacuum distillation at 90° C. Subsequently, a solids content of 23.4% by weight is established by adding water.

The resulting graft polymer has a K value of 17.9, a polydispersity of 2.3 ($M_w$ 26,800, $M_n$ 11,700) and a degree of branching of 0.6% (corresponds to 0.33 graft site/50 EO units).

Graft Polymer 6

A polymerization pressure vessel equipped with stirrer and reflux condenser is initially charged with 444 g of polyethylene glycol ($M_n$ 6000) under a nitrogen atmosphere and melted at 90° C.

After addition of 0.55 g of tert-butyl per-2-ethylhexanoate, dissolved in 1.7 g of tripropylene glycol, and stirring for a further 15 minutes, 666 g of vinyl acetate within 6 h (feed 1) and 7.22 g of tert-butyl peroxy-2-ethylhexanoate, dissolved in 21.6 g of tripropylene glycol, within 6.5 h (feed 2), and also, beginning 3 h after the start of feed 1, 233 g of alkoxylated 2-propylheptanol (1 mol of PO and 10 mol of EO/mol) within 3.5 h (feed 3) are metered in in parallel continuously with constant flow rates at internal temperature 90° C. with stirring.

After the end of feeds 2 and 3 and subsequent stirring at 90° C. for a further hour, 6.1 g of tert-butyl peroxy-2-ethylhexanoate, dissolved in 18.25 g of tripropylene glycol, are added in 3 portions at 90° C. with further stirring for two hours in each case.

Residue amounts of vinyl acetate are removed by vacuum distillation at 90° C. Subsequently, a solids content of 86.9% by weight is established by adding water.

The resulting graft polymer has K value of 17.6, a polydispersity of 1.8 ($M_w$ 35,700, $M_n$ 20,000) and a degree of branching of 0.9% (corresponds to 0.33 graft site/50 EO units).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of cleaning a dishware with a liquid detergent composition comprising an amphiphilic graft polymer; said method comprising the steps of contacting said composition with said dishware, wherein said polymer is a random graft copolymer having a hydrophilic backbone comprising monomers selected from the group consisting of ethers, alcohols, aldehydes, ketones or esters, sugar units, alkoxy units, and saturated polyalcohols, and mixtures thereof, and hydrophobic side chains selected from the group consisting of a $C_{4-25}$ alkyl group, polypropylene, polybutylene, and a mixture thereof;

wherein the graft polymer is further characterized by being based on water-soluble polyalkylene oxides comprising alkylene oxide units (A) as backbone and side chains formed by polymerization of a vinyl ester component (B), said polymer having an average of ≦1 graft site per 50 alkylene oxide units and mean molar masses $M_w$ of from about 3,000 to about 100,000;

wherein the graft polymer has (A) from about 20% to about 70% by weight of the water-soluble polyalkylene oxide as a backbone, wherein the polyalkylene oxide is capped at least at one end by a C1-C25 alkyl group having a mean molar mass Mn from 1500 to 20,000;

(B) side chains formed by free-radical polymerization in the presence of (A) of from about 30% to about 80% by weight of a vinyl ester component composed of (B1) from about 70% to about 100% by weight of vinyl acetate and/or vinyl propionate and (B2) from 0 to about 30% by weight of a further ethylenically unsaturated monomer in the presence of (A);

wherein the composition further comprises from about 0.01% to about 10% by weight of the composition of an alkoxylated polyethyleneimine polymer comprising a polyethyleneimine backbone having from about 400 to about 10,000 weight average molecular weight and the alkoxylated polyethyleneimine polymer further comprises:

(1) one or two alkoxylation modifications per nitrogen atom of the polyethyleneimine backbone by a polyalkoxylene chain having an average of about 1 to about 30 alkoxy moieties per modification, wherein the terminal alkoxy moiety of the alkoxylation modification is capped with hydrogen, a $C_1$-$C_4$ alkyl or mixtures thereof;

(2) a substitution of one $C_1$-$C_4$ alkyl moiety or a benzyl moiety and one or two alkoxylation modifications per nitrogen atom of the polyethyleneimine backbone by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

2. A method of cleaning a dishware according to claim 1 wherein the polymer is further characterized as a random graft copolymer having a hydrophilic backbone comprising polyethylene glycol of molecular weight from about 4,000 to about 15,000, and from about 50% to about 65% by weight hydrophobic side chains formed by polymerising at least one monomer selected from vinyl acetate, vinyl propionate and/or butyl acrylate.

3. A method of cleaning a dishware according to claim 1 wherein the capped polyethylene glycols have a mean molars mass $M_n$ of from 2,500 to 15,000.

4. A method of cleaning a dishware according to claim 3 wherein the graft polymer has a polydispersity $M_w/M_n$ of ≦3.

5. A method of cleaning a dishware according to claim 3 wherein the graft polymer comprises ≦10% by weight of polyvinyl ester (B) in ungrafted form.

6. A method of cleaning a dishware according to claim 3 wherein the content of graft polymers in (B2) is from 0.5% to 20% by weight of n-butyl acrylate.

7. A method of cleaning a dishware according to claim 1, wherein about 0.01 ml to about 150 ml of said liquid detergent composition is diluted in about 2,000 ml to about 20,000 ml water, and the dishware is immersed in the diluted composition thus obtained and cleaned by contacting the soiled surface of the dishware with a cloth, a sponge or a similar article.

8. A method of cleaning a dishware according to claim 1, wherein the dishware is immersed in a water bath or held under running water and an effective amount of a liquid detergent composition is absorbed onto a device, and the device with the absorbed liquid detergent composition is contacted individually to the surface of each of the soiled dishware.

9. A method of cleaning a dishware according to claim 1 wherein the composition comprises about 1.0% to about 50% of one or more surfactants by weight of the total composition.

10. A method of cleaning a dishware according to claim 9 wherein the composition comprises from about 5% to about 40% of one or more surfactants by weight of the total composition.

11. A method of cleaning a dishware according to claim 1 wherein the composition comprises at least 5% by weight of one or more anionic surfactants by weight of the total composition.

12. A method of cleaning a dishware according to claim 11 wherein the anionic surfactant is selected from the group consisting of an anionic sulphonate surfactant, an anionic sulphate surfactant and mixtures thereof.

13. A method of cleaning a dishware according to claim 1 wherein the composition further comprises from about 0.1% to about 15% by weight of the liquid detergent composition of an amine oxide.

14. A method of cleaning a dishware according to claim 1 wherein the alkoxylation modifications are selected from ethoxy moieties (EO), 1,2-propoxy moieties (1,2-PO), 1,3-propoxy moieties (1,3-PO), butoxy moieties (BO), and combinations thereof.

15. A method of cleaning a dishware according to claim 14 wherein the alkoxylation modifications are selected from ethoxy moieties, ethoxy/1,3-propoxy block moieties and ethoxy/1,2-propoxy block moieties.

16. A method of cleaning a dishware according to claim 1 wherein the alkoxylation modifications are ethoxy/1,3-propoxy block moieties and ethoxy/1,2-propoxy block moieties having an average degree of ethoxylation from about 5 to about 15 and an average degree of propoxylation from about 1 to about 16.

* * * * *